US006601737B1

(12) United States Patent
Sandler

(10) Patent No.: US 6,601,737 B1
(45) Date of Patent: Aug. 5, 2003

(54) BABY WIPE/RASH CREAM DISPENSER

(76) Inventor: Kimberly L. Sandler, 3609 Bass Hill La., Fayetteville, NC (US) 28301

( * ) Notice: Subject to any disclaimer, the term of this patent is extended or adjusted under 35 U.S.C. 154(b) by 62 days.

(21) Appl. No.: 09/957,130

(22) Filed: Sep. 20, 2001

Related U.S. Application Data

(60) Provisional application No. 60/233,530, filed on Sep. 19, 2000.

(51) Int. Cl.[7] ..... B67D 5/64

(52) U.S. Cl. ..... 222/192; 222/130; 222/321.7; 222/383.1; 206/229; 206/581

(58) Field of Search ..... 206/210, 229, 206/581; 221/199, 282; 222/130, 192, 321.1, 321.7, 321.9, 372, 383.1, 385

(56) References Cited

U.S. PATENT DOCUMENTS 2,985,289 A * 5/1961 U'ren ..... 206/229
4,582,227 A * 4/1986 Kanfer ..... 222/153.09
5,253,786 A * 10/1993 Schmidt ..... 222/153.03
5,785,179 A * 7/1998 Buczwinski et al. ..... 206/494
2001/0035416 A1 * 11/2001 Dodson ..... 220/524

* cited by examiner

*Primary Examiner*—Ehud Gartenberg
*Assistant Examiner*—Patrick Buechner
(74) *Attorney, Agent, or Firm*—Joseph N. Breaux

(57) ABSTRACT

A baby wipe/rash cream dispenser that allows the user to retrieve baby wipes and rash medication with one hand while using the other hand to maintain the safety of the baby. The baby wipe/rash cream dispenser comes in a first embodiment having a moisture tight seal and two compartments one for baby wipes and one for rash cream which are each accessible when the lid is open. The second embodiment includes a housing having a sealable lid compartment for baby wipes and a separate lid compartment for rash cream that is provided with a pump mechanism for allowing the user to pump the rash cream from the reservoir without the need for opening the lid.

1 Claim, 2 Drawing Sheets

BABY WIPE/RASH CREAM DISPENSER

This application claims benefit to provisional application No. 60/233,530 filed Aug. 19, 2000.

TECHNICAL FIELD

The present invention relates to baby product accessories and more particularly to a baby wipe/rash cream dispenser that includes a housing having a flip top lid allowing access into a compartment for containing a number of baby wipes; the flip top lid forming an air tight seal when in a closed position so that the baby wipes can be either dry or moist; a second compartment is provided that has a pump mechanism provided on a sealable pivoting lid which is fillable with a rash cream or the like and which when sealed allows the user to pump the contents from the reservoir or cavity out through the pump for use to apply to the baby as necessary.

BACKGROUND OF INVENTION

It is often desirable to have baby wipes and rash creams readily available when changing a baby's diaper. This can be bothersome trying to locate both the wipes and the rash medication as well as the unstable nature of the wipe container and rash containers require the user to both hands while obtaining wipes and/or rash medication which causes a dangerous situation because the baby is left unsecured by the hands of the care giver. It would be desirable, therefore, to have a stable baby wipe, rash cream dispenser that included containment structures for both the baby wipes and rash cream and which was sufficiently stable to allow the user have one hand on the baby at all times while allow the other hand to be used to retrieve a baby wipe and or operate a pump mechanism of the diaper rash medication reservoir.

SUMMARY OF INVENTION

It is thus an object of the invention to provide a baby wipe/rash cream dispenser that includes a housing having a flip top lid allowing access into a compartment for containing a number of baby wipes; the flip top lid forming an air tight seal when in a closed position so that the baby wipes can be either dry or moist; a second compartment is provided that has a pump mechanism provided on a sealable pivoting lid which is fillable with a rash cream or the like and which when sealed allows the user to pump the contents from the reservoir or cavity out through the pump for use to apply to the baby as necessary.

Accordingly, a baby wipe/rash cream dispenser is provided. The baby wipe/rash cream dispenser includes a housing having a flip top lid allowing access into a compartment for containing a number of baby wipes; the flip top lid forming an air tight seal when in a closed position so that the baby wipes can be either dry or moist; a second compartment is provided that has a pump mechanism provided on a sealable pivoting lid which is fillable with a rash cream or the like and which when sealed allows the user to pump the contents from the reservoir or cavity out through the pump for use to apply to the baby as necessary.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
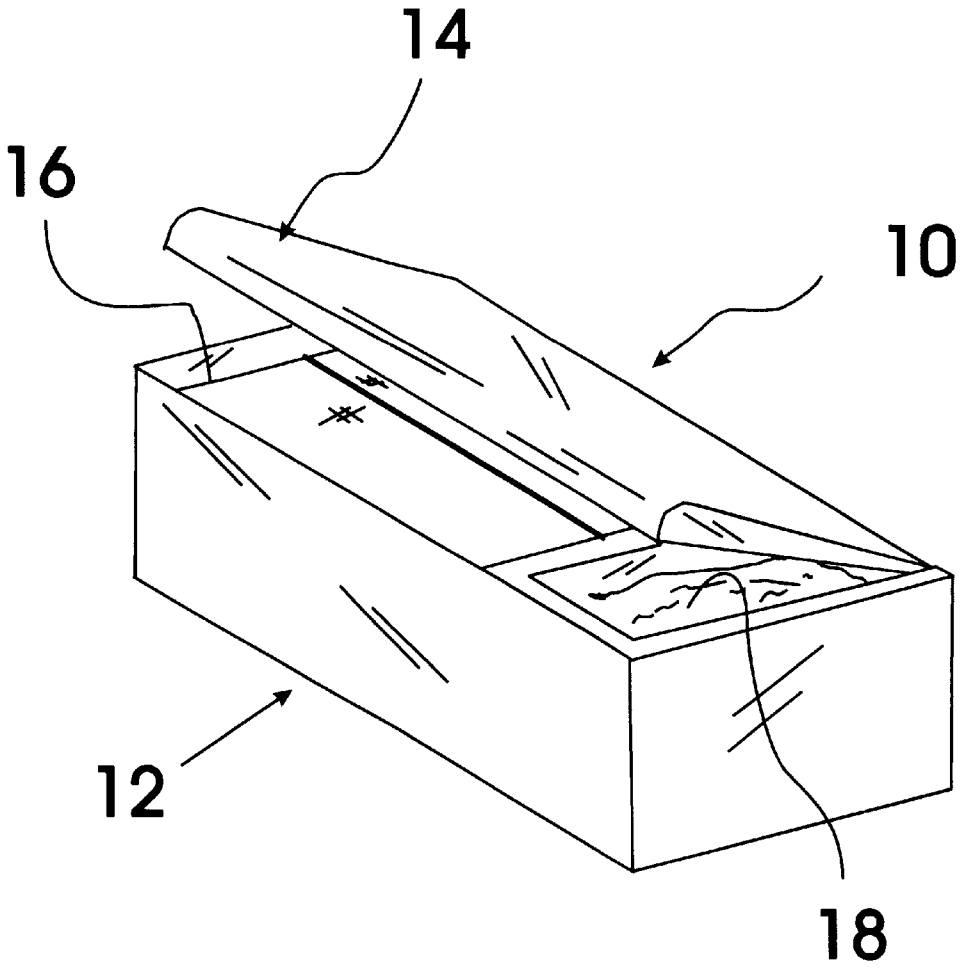
FIG. 1 shows and exemplary embodiment of a baby wipe/rash cream dispenser of the present invention.
Figure 2:
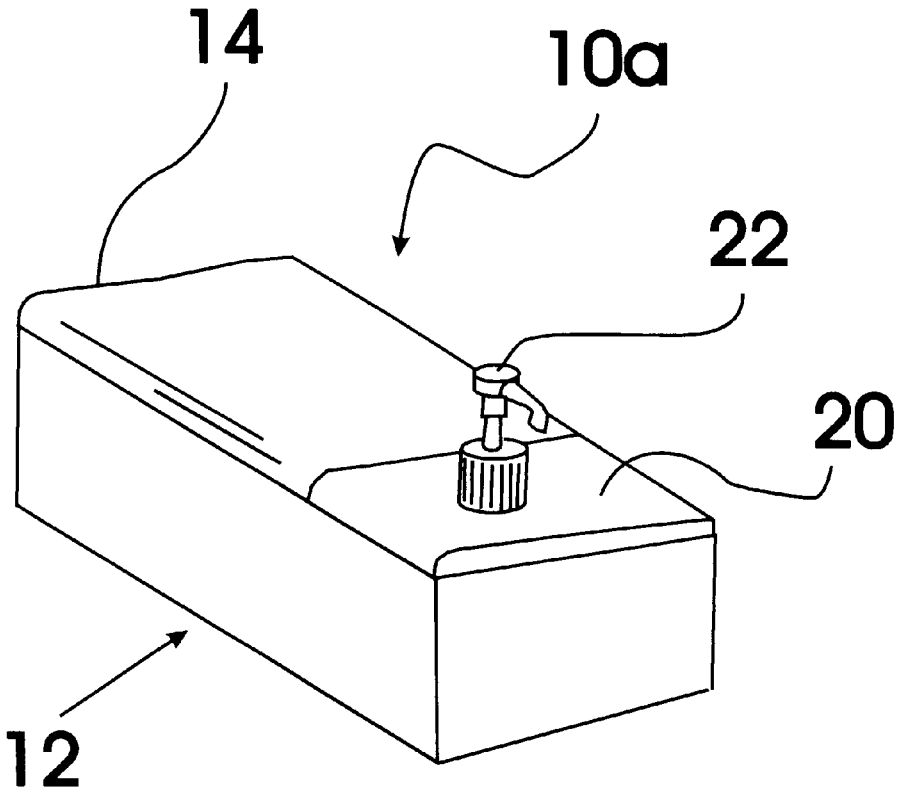
FIG. 2 a second exemplary embodiment having a pump nozzle for allowing pump dispensing of the rash cream from the rash cream reservoir.

FIGS. 1 and 2 show various aspects of exemplary embodiments of the baby wipe/rash cream dispenser of the present invention generally designated 10 and 10*a*. Each of the baby wipe/rash cream dispenser 10 and 10*a* includes a housing generally designated 12 which includes a flip top air tight lid 14 that provides access into a baby wipe chamber 16 in which dry or moist baby wipes can be stored. Each of the housings 12 also each include a rash cream cavity 18 that is filled with a quantity of rash alleviating cream. In FIG. 1, baby wipe/rash cream dispenser 10 has a lid 14 which covers the opening of rash cream cavity which covers the opening of rash cream cavity 18. In FIG. 2 baby wipe/rash cream dispenser 10*a* has a second air tight sealed lid 20 provided with a pump dispenser assembly 22 that allows the user to pump the contents of the rash cream cavity out by pumping pump 22 instead of opening sealable lid 20.

It can be seen from the preceding description that a baby wipe/rash cream dispenser has been provided.

It is noted that the embodiment of the baby wipe/rash cream dispenser described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A baby wipe/rash cream dispenser comprising:

a housing having a flip top lid allowing access into a first compartment containing a number of baby wipes therein;

the flip top lid forming an air tight seal when in a closed position so that the baby wipes can be either dry or moist;

the housing having a second compartment provided therein;

a pump mechanism in connection with a sealable pivoting lid for sealing the second compartment;

the second compartment being filled with cream and sealed using the sealable pivoting lid in a manner to allow a user to operate the pump mechanism to pump the cream from the second compartment for use to apply to a baby as necessary.

* * * * *